US008414322B2

(12) United States Patent
Montena

(10) Patent No.: US 8,414,322 B2
(45) Date of Patent: Apr. 9, 2013

(54) PUSH-ON CATV PORT TERMINATOR

(75) Inventor: Noah Parnall Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 12/967,186

(22) Filed: Dec. 14, 2010

(65) Prior Publication Data

US 2012/0145454 A1 Jun. 14, 2012

(51) Int. Cl.
*H01R 13/52* (2006.01)

(52) U.S. Cl.
USPC ..... 439/277

(58) Field of Classification Search ..... 439/277, 439/578, 583, 584
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

(Continued)

*Primary Examiner* — Amy Cohen Johnson
*Assistant Examiner* — Vladimir Imas
(74) *Attorney, Agent, or Firm* — Schmeiser, Olsen & Watts LLP

(57) ABSTRACT

A novel, reliable, easy-to-install terminator device assembly for cable ports is provided. Such a terminator device includes the necessary sufficiently high resistance element to prevent reflectance of signals through a cable system as well as means to permit push-on (axial) installation on a threaded cable port. Additionally, the novel terminator device includes a metal contact basket with internal extensions that allow for such axial installation but are aligned in such a manner as to contact with the port threads to prevent removal through axial movement. Such internal extensions are also aligned uniformly around the subject port such that the ends of each internal extension exhibit flanges that will follow the helical edge of the threaded port when turned. In this manner, terminators may be provided that are easy to install and can withstand vibrational forces and other detrimental actions that could permit movement and/or removal of the terminator assembly from the subject port. A method of providing a suitable port termination for improved cable system signal strength is also encompassed within this invention.

26 Claims, 3 Drawing Sheets

U.S. PATENT DOCUMENTS

| | | | | | |
|---|---|---|---|---|---|
| 2,755,331 | A | | 7/1956 | Melcher | |
| 2,757,351 | A | | 7/1956 | Klostermann | |
| 2,762,025 | A | | 9/1956 | Melcher | |
| 2,805,399 | A | | 9/1957 | Leeper | |
| 2,870,420 | A | | 1/1959 | Malek | |
| 3,001,169 | A | | 9/1961 | Blonder | |
| 3,015,794 | A | | 1/1962 | Kishbaugh | |
| 3,091,748 | A | | 5/1963 | Takes et al. | |
| 3,094,364 | A | | 6/1963 | Lingg | |
| 3,184,706 | A | | 5/1965 | Atkins | |
| 3,194,292 | A | | 7/1965 | Borowsky | |
| 3,196,382 | A | | 7/1965 | Morello, Jr. | |
| 3,245,027 | A | | 4/1966 | Ziegler, Jr. | |
| 3,275,913 | A | | 9/1966 | Blanchard et al. | |
| 3,278,890 | A | | 10/1966 | Cooney | |
| 3,281,757 | A | | 10/1966 | Bonhomme | |
| 3,292,136 | A | | 12/1966 | Somerset | |
| 3,320,575 | A | | 5/1967 | Brown et al. | |
| 3,321,732 | A | | 5/1967 | Forney, Jr. | |
| 3,336,563 | A | | 8/1967 | Hyslop | |
| 3,348,186 | A | | 10/1967 | Rosen | |
| 3,350,677 | A | | 10/1967 | Daum | |
| 3,355,698 | A | | 11/1967 | Keller | |
| 3,373,243 | A | | 3/1968 | Janowiak et al. | |
| 3,390,374 | A | | 6/1968 | Forney, Jr. | |
| 3,406,373 | A | | 10/1968 | Forney, Jr. | |
| 3,430,184 | A | * | 2/1969 | Acord | 439/255 |
| 3,448,430 | A | * | 6/1969 | Kelly | 439/607.52 |
| 3,453,376 | A | | 7/1969 | Ziegler, Jr. et al. | |
| 3,465,281 | A | | 9/1969 | Florer | |
| 3,475,545 | A | | 10/1969 | Stark et al. | |
| 3,494,400 | A | | 2/1970 | McCoy et al. | |
| 3,498,647 | A | | 3/1970 | Schroder | |
| 3,501,737 | A | | 3/1970 | Harris et al. | |
| 3,517,373 | A | | 6/1970 | Jamon | |
| 3,526,871 | A | | 9/1970 | Hobart | |
| 3,533,051 | A | | 10/1970 | Ziegler, Jr. | |
| 3,537,065 | A | | 10/1970 | Winston | |
| 3,544,705 | A | | 12/1970 | Winston | |
| 3,551,882 | A | | 12/1970 | O'Keefe | |
| 3,564,487 | A | | 2/1971 | Upstone et al. | |
| 3,587,033 | A | | 6/1971 | Brorein et al. | |
| 3,601,776 | A | | 8/1971 | Curl | |
| 3,629,792 | A | | 12/1971 | Dorrell | |
| 3,633,150 | A | | 1/1972 | Swartz | |
| 3,646,502 | A | | 2/1972 | Hutter et al. | |
| 3,663,926 | A | | 5/1972 | Brandt | |
| 3,665,371 | A | | 5/1972 | Cripps | |
| 3,668,612 | A | | 6/1972 | Nepovim | |
| 3,669,472 | A | | 6/1972 | Nadsady | |
| 3,671,922 | A | | 6/1972 | Zerlin et al. | |
| 3,678,444 | A | | 7/1972 | Stevens et al. | |
| 3,678,445 | A | | 7/1972 | Brancaleone | |
| 3,680,034 | A | | 7/1972 | Chow et al. | |
| 3,681,739 | A | | 8/1972 | Kornick | |
| 3,683,320 | A | | 8/1972 | Woods et al. | |
| 3,686,623 | A | | 8/1972 | Nijman | |
| 3,694,792 | A | | 9/1972 | Wallo | |
| 3,706,958 | A | | 12/1972 | Blanchenot | |
| 3,710,005 | A | | 1/1973 | French | |
| 3,739,076 | A | | 6/1973 | Schwartz | |
| 3,744,007 | A | | 7/1973 | Horak | |
| 3,744,011 | A | | 7/1973 | Blanchenot | |
| 3,778,535 | A | | 12/1973 | Forney, Jr. | |
| 3,781,762 | A | | 12/1973 | Quackenbush | |
| 3,781,898 | A | | 12/1973 | Holloway | |
| 3,793,610 | A | | 2/1974 | Brishka | |
| 3,798,589 | A | | 3/1974 | Deardurff | |
| 3,808,580 | A | | 4/1974 | Johnson | |
| 3,810,076 | A | | 5/1974 | Hutter | |
| 3,835,443 | A | | 9/1974 | Arnold et al. | |
| 3,836,700 | A | | 9/1974 | Niemeyer | |
| 3,845,453 | A | | 10/1974 | Hemmer | |
| 3,846,738 | A | | 11/1974 | Nepovim | |
| 3,854,003 | A | | 12/1974 | Duret | |
| 3,858,156 | A | * | 12/1974 | Zarro | 439/221 |
| 3,879,102 | A | | 4/1975 | Horak | |
| 3,886,301 | A | | 5/1975 | Cronin et al. | |
| 3,907,399 | A | | 9/1975 | Spinner | |
| 3,910,673 | A | | 10/1975 | Stokes | |
| 3,915,539 | A | | 10/1975 | Collins | |
| 3,936,132 | A | | 2/1976 | Hutter | |
| 3,953,097 | A | | 4/1976 | Graham | |
| 3,960,428 | A | | 6/1976 | Naus et al. | |
| 3,963,320 | A | | 6/1976 | Spinner | |
| 3,963,321 | A | | 6/1976 | Burger et al. | |
| 3,970,355 | A | | 7/1976 | Pitschi | |
| 3,972,013 | A | | 7/1976 | Shapiro | |
| 3,976,352 | A | | 8/1976 | Spinner | |
| 3,980,805 | A | | 9/1976 | Lipari | |
| 3,985,418 | A | | 10/1976 | Spinner | |
| 4,017,139 | A | * | 4/1977 | Nelson | 439/352 |
| 4,022,966 | A | | 5/1977 | Gajajiva | |
| 4,030,798 | A | | 6/1977 | Paoli | |
| 4,046,451 | A | | 9/1977 | Juds et al. | |
| 4,053,200 | A | | 10/1977 | Pugner | |
| 4,059,330 | A | | 11/1977 | Shirey | |
| 4,079,343 | A | | 3/1978 | Nijman | |
| 4,082,404 | A | | 4/1978 | Flatt | |
| 4,090,028 | A | | 5/1978 | Vontobel | |
| 4,093,335 | A | | 6/1978 | Schwartz et al. | |
| 4,106,839 | A | | 8/1978 | Cooper | |
| 4,109,126 | A | | 8/1978 | Halbeck | |
| 4,125,308 | A | | 11/1978 | Schilling | |
| 4,126,372 | A | | 11/1978 | Hashimoto et al. | |
| 4,131,332 | A | | 12/1978 | Hogendobler et al. | |
| 4,150,250 | A | | 4/1979 | Lundeberg | |
| 4,153,320 | A | | 5/1979 | Townshend | |
| 4,156,554 | A | | 5/1979 | Aujla | |
| 4,165,911 | A | | 8/1979 | Laudig | |
| 4,168,921 | A | | 9/1979 | Blanchard | |
| 4,173,385 | A | | 11/1979 | Fenn et al. | |
| 4,174,875 | A | | 11/1979 | Wilson et al. | |
| 4,187,481 | A | | 2/1980 | Boutros | |
| 4,225,162 | A | | 9/1980 | Dola | |
| 4,227,765 | A | | 10/1980 | Neumann et al. | |
| 4,229,714 | A | | 10/1980 | Yu | |
| 4,250,348 | A | | 2/1981 | Kitagawa | |
| 4,280,749 | A | | 7/1981 | Hemmer | |
| 4,285,564 | A | | 8/1981 | Spinner | |
| 4,290,663 | A | | 9/1981 | Fowler et al. | |
| 4,296,986 | A | | 10/1981 | Herrmann et al. | |
| 4,307,926 | A | | 12/1981 | Smith | |
| 4,322,121 | A | | 3/1982 | Riches et al. | |
| 4,326,769 | A | * | 4/1982 | Dorsey et al. | 439/21 |
| 4,339,166 | A | | 7/1982 | Dayton | |
| 4,346,958 | A | | 8/1982 | Blanchard | |
| 4,354,721 | A | | 10/1982 | Luzzi | |
| 4,358,174 | A | | 11/1982 | Dreyer | |
| 4,373,767 | A | | 2/1983 | Cairns | |
| 4,389,081 | A | | 6/1983 | Gallusser et al. | |
| 4,400,050 | A | | 8/1983 | Hayward | |
| 4,407,529 | A | | 10/1983 | Holman | |
| 4,408,821 | A | | 10/1983 | Forney, Jr. | |
| 4,408,822 | A | | 10/1983 | Nikitas | |
| 4,412,717 | A | * | 11/1983 | Monroe | 439/582 |
| 4,421,377 | A | | 12/1983 | Spinner | |
| 4,426,127 | A | | 1/1984 | Kubota | |
| 4,444,453 | A | | 4/1984 | Kirby et al. | |
| 4,452,503 | A | | 6/1984 | Forney, Jr. | |
| 4,456,323 | A | | 6/1984 | Pitcher et al. | |
| 4,462,653 | A | | 7/1984 | Flederbach et al. | |
| 4,464,000 | A | | 8/1984 | Werth et al. | |
| 4,464,001 | A | * | 8/1984 | Collins | 439/318 |
| 4,469,386 | A | | 9/1984 | Ackerman | |
| 4,470,657 | A | | 9/1984 | Deacon | |
| 4,484,792 | A | | 11/1984 | Tengler et al. | |
| 4,484,796 | A | | 11/1984 | Sato et al. | |
| 4,490,576 | A | | 12/1984 | Bolante et al. | |
| 4,506,943 | A | | 3/1985 | Drogo | |
| 4,515,427 | A | | 5/1985 | Smit | |
| 4,525,017 | A | | 6/1985 | Schildkraut et al. | |
| 4,531,790 | A | | 7/1985 | Selvin | |
| 4,531,805 | A | | 7/1985 | Werth | |
| 4,533,191 | A | | 8/1985 | Blackwood | |
| 4,540,231 | A | | 9/1985 | Forney, Jr. | |
| RE31,995 | E | | 10/1985 | Ball | |

4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A * 4/1987 Stursa ..... 439/582
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A * 6/1989 Pauza et al. ..... 439/620.04
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A * 7/1990 Guimond et al. ..... 439/578
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A * 7/1992 Gershfeld ..... 439/357
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A * 3/1993 Szegda ..... 439/394
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.

5,456,611 A 10/1995 Henry et al.
5,456,614 A 10/1995 Szegda
5,466,173 A 11/1995 Down
5,470,257 A 11/1995 Szegda
5,474,478 A * 12/1995 Ballog ..... 439/805
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 * 7/2001 Arcykiewicz et al. ..... 439/253
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 * 12/2002 Perry ..... 439/620.03
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 * 8/2004 Montena ..... 439/253
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 * 12/2006 Burris et al. ..... 439/578
7,147,509 B1 12/2006 Burris et al.
7,156,696 B1 1/2007 Montena
7,161,785 B2 1/2007 Chawgo
7,179,121 B1 2/2007 Burris et al.
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 * 5/2008 Gale ..... 324/538
7,393,245 B2 7/2008 Palinkas et al.
7,404,737 B1 7/2008 Youtsey
7,452,239 B2 11/2008 Montena
7,455,550 B1 * 11/2008 Sykes ..... 439/584
7,462,068 B2 12/2008 Amidon
7,476,127 B1 1/2009 Wei
7,479,035 B2 1/2009 Bence et al.
7,488,210 B1 * 2/2009 Burris et al. ..... 439/578
7,494,355 B2 * 2/2009 Hughes et al. ..... 439/181
7,497,729 B1 3/2009 Wei
7,507,117 B2 3/2009 Amidon

| | | | | |
|---|---|---|---|---|
| 7,544,094 | B1 | 6/2009 | Paglia et al. | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,753,727 | B1 | 7/2010 | Islam et al. | |
| 7,794,275 | B2 | 9/2010 | Rodrigues | |
| 7,806,714 | B2 * | 10/2010 | Williams et al. | 439/352 |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,830,154 | B2 * | 11/2010 | Gale | 324/538 |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,887,354 | B2 | 2/2011 | Holliday | |
| 7,892,004 | B2 * | 2/2011 | Hertzler et al. | 439/312 |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 7,955,126 | B2 | 6/2011 | Bence et al. | |
| 7,972,158 | B2 * | 7/2011 | Wild et al. | 439/257 |
| 8,029,315 | B2 | 10/2011 | Purdy et al. | |
| 8,062,044 | B2 | 11/2011 | Montena et al. | |
| 8,062,063 | B2 | 11/2011 | Malloy et al. | |
| 8,075,337 | B2 | 12/2011 | Malloy et al. | |
| 8,075,338 | B1 | 12/2011 | Montena | |
| 8,079,860 | B1 | 12/2011 | Zraik | |
| 8,113,875 | B2 | 2/2012 | Malloy et al. | |
| 8,152,551 | B2 | 4/2012 | Zraik | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2006/0292927 | A1 * | 12/2006 | Burris et al. | 439/587 |
| 2007/0026734 | A1 | 2/2007 | Bence et al. | |
| 2007/0049113 | A1 | 3/2007 | Rodrigues et al. | |
| 2007/0123101 | A1 * | 5/2007 | Palinkas | 439/579 |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 * | 4/2010 | Burris et al. | 439/578 |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy et al. | |
| 2010/0279548 | A1 * | 11/2010 | Montena et al. | 439/620.04 |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |
| 2012/0094532 | A1 | 4/2012 | Montena | |
| 2012/0171894 | A1 | 7/2012 | Malloy et al. | |
| 2012/0202378 | A1 | 8/2012 | Krenceski et al. | |
| 2012/0214342 | A1 | 8/2012 | Mathews | |
| 2012/0222302 | A1 | 9/2012 | Purdy et al. | |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B9 | 4/2010 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

OTHER PUBLICATIONS

U.S. Appl. No. 13/157,340, filed Jun. 10, 2011.

* cited by examiner

PUSH-ON CATV PORT TERMINATOR

FIELD OF THE INVENTION

A novel, reliable, easy-to-install terminator device assembly for cable ports is provided. Such a terminator device includes the necessary sufficiently high resistance element to prevent reflectance of signals through a cable system as well as means to permit push-on (axial) installation on a threaded cable port with further means to prevent removal through axial movement.

BACKGROUND OF THE INVENTION

Cable television systems are typically configured to provide a main transmitter source with multiple splitters and branchers supplying the proper conduits of transmission signals to various locations. Unfortunately, as such signals are split, the signal level suffers gradual attenuation as a result of split loss and cable loss. As a result, the overall characteristics of the system may deteriorate severely at certain frequencies. Such deterioration in input impedance may lead to phase distortion and amplitude distortion, damaging signal quality.

Such unwanted system deterioration my be caused by the lack of proper termination of vacant end ports. Generally, it has been observed that when a brancher/splitter subscriber terminal includes a vacant terminal (one to which no lead-in wire is connected), reflected waves are returned to the input terminal of the branching/splitting circuit. The amount of reflection differs between branchers with few branches and branchers with a comparatively large number of branches, reflection being greater when the number of branches is large. In general, CATV systems include a considerable number of vacant terminals, which are provided beforehand in anticipation of an increase in the number of subscribers after the system becomes operational. As the number of subscribers increases, the number of vacant terminals is reduced. In addition, a vacant terminal is created when a subscriber cancels his subscription.

Conventionally, reflection to the input terminal caused by such vacant terminals is prevented by connecting a terminator with a resistance element. Such terminator devices typically include a resistance element to properly prevent reflectance of transmission signals and waves. Unfortunately, such typical terminator devices also include standard clip-on, push-on, or screw-on means for attachment to the vacant terminal ports within the subject cable system. As such, and since such terminator devices are intended to remain on such vacant terminals indefinitely, there is a necessity to reduce the potential that such terminator devices can become detached or loosened (and thereby reducing the needed contact between the port and the resistance element therein) during such an indefinite installation. For instance, when push-on devices alone are utilized, the resultant connection remains susceptible to creep, fatigue, and/or hysteresis factors, particularly if removal of such devices is achieved through axial force application opposite to that required for installation. Such susceptibility to creep, fatigue, etc., appears to exist even if very high compression forces are utilized to attach such push-on devices during installation. Basically, it has been realized that in any physical system that relies solely upon the continued dimensional stability of its component parts, such as, in this situation, the same degree of elastomeric deformation over time and through continued utilization under, again, solely compression forces, there will always be a strong possibility of loss of performance (i.e., the aforementioned creep, fatigue and/or hysteresis). The variability of the sole component providing the compression force remains the weak link in the connection chain, in other words. As such, there remains a distinct probability of performance reduction, if not all out failure, of such a specific elastic connection device.

Screw-type mechanisms exhibit similar degrees of unreliability, but for different reasons. As alluded to above, such terminator devices, if undertaken thoroughly by the installer, can be secure in terms of reflectance prevention initially; however, over time, the potential for problems in this area are relatively high. For instance, if the installer does not properly and/or completely screw the connection into the desired port, or if the screw mechanism itself is askew when installed, then potential vibrational influences may loosen the screw leading to the possible compromise of the overall connection itself. Additionally, typical screw-type mechanisms are difficult to operate by hand, and typical terminal ports are also placed in hard-to-reach locations for properly configured wrenches to be applied for tightening. As such, the reliability of such terminator devices, which have been predominant in the cable industry in the past, have been highly suspect. The general requirement to tighten such connections through multiple revolutions of the screw portion itself, coupled with the general lack of determinability of the proper level of tightening needed for full contact between the terminator and the target port, leads as well to the same type of potential signal distortion possibilities that the industry wishes to avoid. As with both screw-on and push-on (or clip-on) devices, vibrational effects may dislodge or loosen the connection. With any such loosening or detachment of terminator devices in this manner, the overall effectiveness of the entire cable television system may be compromised due to wave reflectance from unprotected (or, in effect, improperly protected) vacant terminals. The existence of such vacant or improperly protected terminals causes reflected waves, as described above, resulting in amplitude distortion and phase distortion, and damaging the quality of the signals. This can cause problems such as TV ghost images, bit errors in digital signal data services, and so on.

Advantage of and Brief Description of the Invention

One distinct advantage of the inventive terminator assembly device is the ability to easily affix the connector to either any terminal port (such as at a splitter location or within a dwelling wall) with minimal effort but with extra contact through the inclusion of properly configured locking fingers within an internal conductive metal basket that attach to the external threads of a target port through axial application while preventing removal of the connector from the terminal port through axial force. Past developments for cable port termination devices did not include any extra safeguards to increase the reliability of the connection should creep or fatigue issues occur over time. As such, there is a need for a cable port termination device that substantially reduces input reflection and that remains in place securely without any appreciable movement due to vibrational effects during indefinite installation to a vacant terminal.

Accordingly, this invention encompasses a cable system terminator device assembly for installation over a threaded terminal port, said assembly comprising an electrical resistance article and a conductive metal basket, wherein said metal basket includes a plurality of cut-out extensions (locking fingers) therein such that said cut-out extensions include edges that flex outwardly during axial installation with said port and engage the threads of a port in a manner that prevents axial removal of said terminator device assembly from said port yet permits removal from said port through turning of said terminator device assembly. Thus, such extensions are aligned substantially uniformly around the subject port such that the ends of each extension include flanges that will follow the helical edge of the threaded port when turned. In this manner, the subject terminator facilitates port installation and can withstand vibrational forces and other detrimental actions that could permit movement and/or removal of the terminator assembly from the subject port. Also encompassed within this invention is a method of providing a secure, reliable, and easy-to-install termination at a vacant cable port through the installation of a terminator device assembly to a threaded vacant cable port, wherein the connection between said terminator device assembly and said port is accomplished through applying force axially to the terminator device assembly over the port and removal of such a terminator device assembly therefrom said cable port is through application of external rotational force. Such a method utilizes, in essence, the type of device discussed above. If utilized at an exterior location, the entire device may be housed within an external connector body including an inner cavity in which the device may be disposed.

BRIEF DESCRIPTION OF THE DRAWINGS

The foregoing summary, as well as the following detailed description of embodiments of the invention, will be better understood when read in conjunction with the appended drawings. For the purpose of illustrating the invention, there is shown in the drawings possible embodiments of the overall device. It should be understood, however, that the invention is not limited to the precise arrangements and instrumentalities shown in the drawings. In the figures, the same reference numerals are used to indicate the same elements of each of the illustrated boards.

DETAILED DESCRIPTION OF THE INVENTION AND THE DRAWINGS

Figure 1:
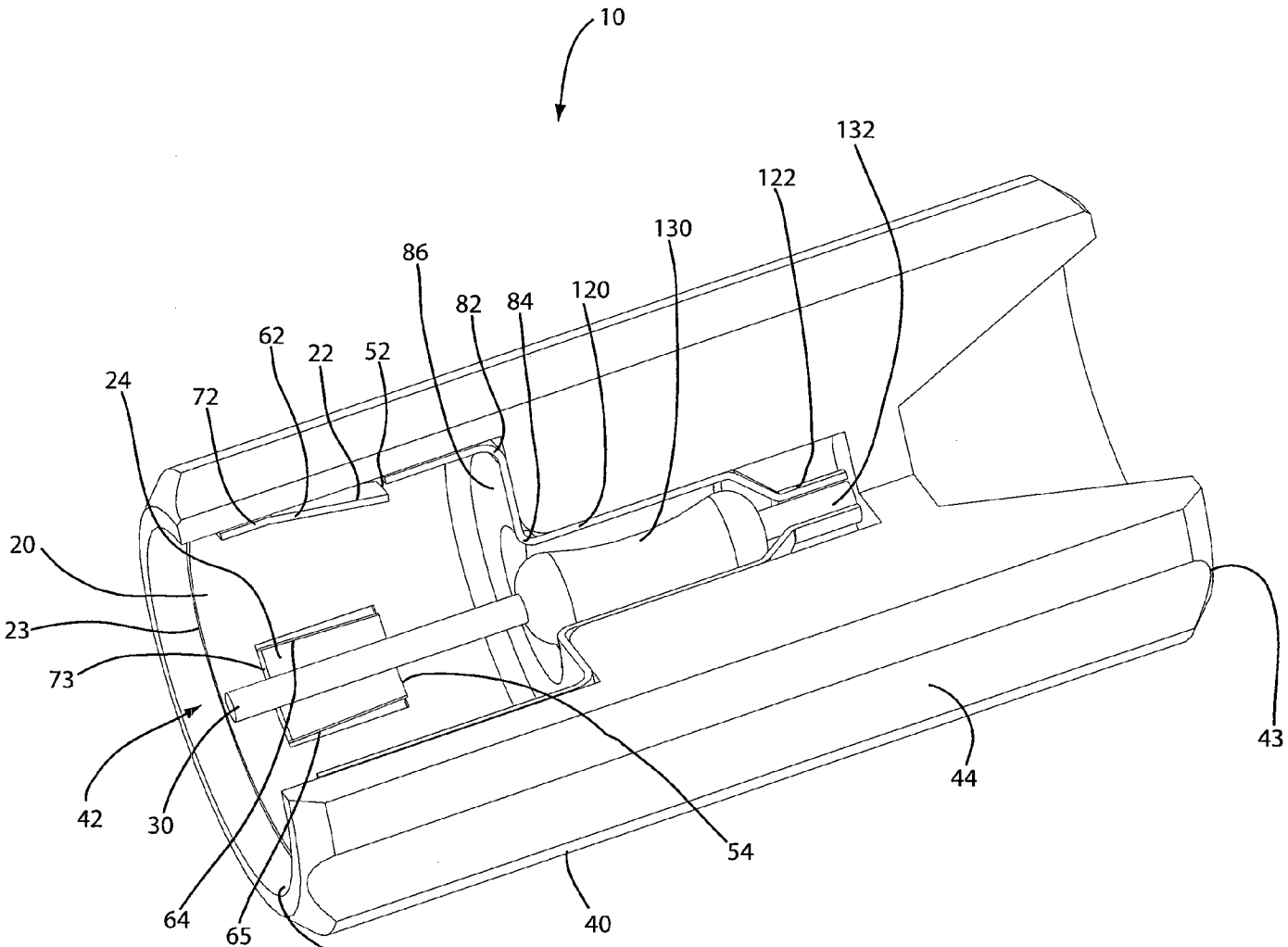
FIG. 1 depicts a partial cutaway view of one embodiment of the invention.

Without any intention of limiting the scope of the novel device discussed herein, greater detailed explanations of the device as well as the representative drawings are provided.

As noted above, the aforementioned broadly stated device includes means for securing a cable port terminator in place. Such a device includes a metal basket 20 with a plurality of extensions 22, 24, 26 disposed therein to engage the threads of a subject port (not illustrated) permitting axial installation, but preventing axial removal therefrom. More particularly, the metal basket component 20 includes an open end and a substantially closed end, wherein the open end includes a top peripheral edge 23 and defines an inner cavity 42 for introduction of the threaded portions of a port (not illustrated), wherein such cut-out extensions 22, 24, 26 are attached to the metal basket 20 at attachment points 72, 73, 74 substantially equidistant from the top edge 23 of the metal basket 20 itself (or of the connector body 40 when present), wherein each of said plurality of conductive metal cut-out extensions 22, 24, 26 extends internally within said inner cavity 42 of the metal basket 20, wherein each of said plurality of cut-out extensions 22, 24, 26 has an edge 52, 54, 56 extended into said metal basket inner cavity 42 that is substantially parallel to the top end peripheral edge 23 of said metal basket 20, and wherein said each of said extended edges 52, 54, 56 of said plurality of cut-out extensions 22, 24, 26 is substantially equidistant from said top end peripheral edge 23 of said metal basket 20 (or, again, the connector body 40 when present) and further away from said top end peripheral edge 23 of said metal basket 20 (or connector body 40) than are said metal basket attachment points 72, 73, 74. Such cut-out extensions 22, 24, 26 (again, also described herein as locking fingers) are thus disposed within the inner cavity 42 of the metal basket 20 (or connector body 40) at an angle from the plane of the metal basket 20 thus exhibiting the ability to flex during axial installation and engage with subject port threads (not illustrated) to prevent axial removal therefrom, as noted above. The substantially equidistant disposition of the cut-out extension top edges 52, 54, 56 creates not only this barrier to axial removal through thread engagement, but permits removal through turning of the entire device 10 along the helical port threads themselves. Generally, the shape of such extensions 22, 24, 26 are three-sided cut-outs from the metal basket base 20 with two parallel edges 62, 63, 64, 65, 66, 67 and a top edge 52, 54, 56; thus the extensions 22, 24, 26 are attached to the metal basket 20 through a fourth edge 72, 73, 74 thereof, thereby creating the above-noted angle of disposition within the metal basket's inner cavity 42 (or, again, when present, such an angle in relation to the connector body 40). Such a plurality of extensions 22, 24, 26 may be of any shape that exhibits the proper dimensional stability and capability to withstand axial installation over a vacant port (by flexing inwardly) and still engage the threads thereof sufficiently to prevent removal in the opposite direction (i.e., pulling)(by flexing outwardly), while simultaneously permitting removal due to the proper engagement with such port threads for helical movement along such a path. Thus, as merely examples, such extensions 22, 24, 26 may include two equilateral sides 62, 63, 64, 65, 66, 67 with a flat top edge 52, 54, 56 (i.e., rectangular with the fourth side being the attachment point 72, 73, 74 with the metal basket 20, substantially the same length as the flat top edge 52, 54, 56), or such sides may be curved, or such sides may either be convex or concave in shape. As well, the extensions 22, 24, 26 may be broader in length at their attachment points 72, 73, 74 than the flat top edges 52, 54, 56. As long as a necessarily flat top edge 52, 54, 56 is provided with the ability of the side portions 62, 63, 64, 65, 66, 67 to flex upon axial installation over a vacant port, and as further discussed above, the extensions 22, 24, 26 are of proper configuration.

Furthermore, the top edge 52, 54, 56 of each cut-out extension 22, 24, 26 is generally located a distance further from the top edge 23 between said metal basket 20 and said external threads of said target port in order to provide the necessary securing of the terminator device assembly 10 over the subject vacant port. In this manner, the cut-out extensions 22, 24, 26 work in engaged concert with the subject port threads. A method of providing a secure, reliable, and easy-to-install terminator device assembly 10 to a vacant terminal port within a cable system, wherein the connection is accomplished through attaching the device 10 noted above, is thus also encompassed within this invention.

In such a manner, provided is a cable system terminator device assembly 10 that permits security and reliability in terms of long-term wave reflectance prevention, as well as simplicity in installation. The angled cut-out extensions within the metal basket 20 engage with the threads of a CATV port when applied axially (pushed-on) over such a port. When applied in such a manner, the included resistance element 30 inserts within the port itself to supply the necessary grounding to prevent or substantially dissipate wave reflectance back to a splitter within the entire system. As described above, the cut-out extensions, while engaged with the port threads, prevent movement of the entire terminator device assembly 10 around and away from the port upon application thereto. Without substantial external forces (i.e., a force strong enough to actually break the metal extensions 22, 24, 26 and/or strip the port threads), the terminator device assembly 10 should not be removable without repeated turning to permit the top edges 52, 54, 56 of the cut-out extensions 22, 24, 26 to rotate around the helical thread of the port. If desired, a seal (not illustrated) (such as, without limitation, a rubber gasket of suitable integrity) may be present as an integral component of the terminator device assembly 10 (such as on the top edge 41 of the connector body 40 or within the metal basket 20 itself) to reduce moisture migration into the port as well as potentially aid in further securing the assembly 10 to the port to reduce potential movement.

The ability to reduce movement of a terminator 10 on a vacant port as well as substantially reduce any propensity for unwanted removal of such a terminator aids in reducing signal loss or dissipation within a local cable system. Such a connection device 10 thus serves to increase reliability of overall signal transmission through the secure connections of the terminator device assembly 10 to the target port itself The external connector body 40 (or just connector body) may be utilized in conjunction with the base device 20 if the entire device 10 is intended for utilization in an exterior location in order to protect the metal basket 20 and electrically conductive post 30, at least, from moisture, inclement weather, and other atmospheric conditions. However, if desired, the user may also utilize a device 10 including the external connector body 40 with an interior cable port location. Such a connector body 40, when present, is attached to the metal basket 20 and includes an external shaped component that facilitates the ability for a user to turn the entire terminator device 10 either manually or through the utilization of a complementary shaped tool (not illustrated) in order to remove such a device 10 from a port when desired. A suitable adhesive may be applied to either the metal basket 20 or the connector body 40 to attain the necessary level of attachment for such a purpose; however, the configuration of the inner cavity 42 of the connector body 40 may also be properly formed as to allow for metal basket 20 insertion during manufacture wherein the basket 20 snaps into place therein and cannot be removed without appreciable force. If an adhesive is applied, such a material may be one or more of a low surface energy adhesive, such as polytetraflouroethane (in tape form, as one example), polyethylene, polypropylene, acrylic polymers, organoborane polymers, silicone adhesive, and the like. Furthermore, any other means for retention that allows for sufficient connection of the basket 20 to the connector body 40 without distortion or interference may be followed as well. Thus, if desired, the basket 20 and connector body 40 may be adjoined through a press-fit, interference fit, or even heat staking (typically through melting of a portion of a plastic connector body 40, if such is utilized, through a small hole or aperture in the basket 20) procedure.

The connector body 40 itself may be made from any suitable material, such as plastic or metal, that is sufficiently durable to with installation and removal as needed. From a cost perspective, such material may be plastic in nature. As such, if desired, such a plastic, or properly selected metal material, may also exhibit low conductivity so as not to interfere with the resistance element present therein. Again, such a low conductivity property is not a requirement for proper utilization of the inventive connector.

The resistance element 30 is generally an elongated pin that fits within the bore (not illustrated) of a subject vacant port and is constructed from a suitable electrically resistant material (such as, without limitation, die-cast zinc, machined brass, silicon, ceramic, hard rubber, and the like) to prevent wave reflectance back to a signal source. Such a resistor may actually exhibit an appreciable level of conductivity, just to a lower degree than that of the wires present within the port into which the element 30 is introduced when in use. Thus, the resistance element 30 will be present within the inner cavity 42 of the connector body 40 to allow for the insertion of a cable port exterior within the connector body 40 while simultaneously permitting the resistance element 30 to enter the bore of the same cable port. Such an element 30 is fastened to the metal basket 20 in any manner that provides a sufficiently reliable connection. Thus, soldering, welding, crimping, interference-fitting, or any other like manner, may be performed for this purpose. The element 30 is effectively situated within the inventive device 10 between the resistor lead most distant from the subject port and the narrow opening in the end of the basket 20 most distant, as well, from the subject port. As such, since the resistance element 30 will still remain in contact with the metal basket 20 and the connector body 40, it is imperative that the fastening means (i.e., solder, etc., as listed above) exhibits a suitable level of electrical conductivity as well. Thus, an insulating (moldable) plastic, such as polycarbonate, polyacrylic, acetal, nylon and the like, would be suitable for such a component. If metal is utilized, however, low conductivity types, such as, as merely examples, die-cast zinc, machined brass, and the like, may be present as well for such a purpose.

The metal basket 20 is a conductive metal. Copper, gold, silver, aluminum, brass, spring steels (stainless), and the like, are suitable for such a purpose. The cap and the exterior of the connector body 40 would generally be made from the same types of materials as the connector body 40. The connector body 40 and the metal basket 20 may be configured in any way to connect with any type of port as well. Thus, although standard cable television ports, f-type, etc., are the most common, the connector body 40 may be configured for RCA, BNC, and PAL connections (among others), too (not illustrated). Thus, the versatility of the termination device assembly 10 provides an excellent manner of improving existing signal strength within a specific CATV system through a simple, yet reliable manner of permitting the installer a push-on connector 10 that does not disengage from a port without application of sufficient rotational forces to the device itself.

With reference to the accompanying drawings, FIG. 1 shows one embodiment of the inventive terminator device assembly particularly with an external connector body present.

As noted above, such a component is not necessary for utilization of the device in an interior cable port connection location. A terminator device assembly 10 includes a cylindrical outer connector body 40 including a top edge 41, a bottom edge 43, and, a plurality of grooves 44 (45, 46, in FIGS. 2 and 3) along its outer periphery, and an inner cavity 42 in which is situated a metal basket 20 and a resistance element 30. The metal basket 20 further includes a plurality of metal cut-out extensions 22, 24 (with a third 26 in FIG. 2) with metal basket attachment points 72,73 (74 in FIG. 2) having top edges 52, 54 (56 in FIG. 2) and two side edges each 62, 64, 65, (63, 66, 67 additionally in FIG. 2) that extend into the inner cavity 42. The metal basket 20 also includes a peripheral top edge 23 that defines the top edge of the open end portion of the metal basket 20. As noted previously, the top edges 52, 54 (56 in FIG. 2) are equidistant from the top edge of the connector body 40 as well as from the peripheral top edge 23 of the metal basket 20 and further within the inner cavity than are the metal basket attachment points 72, 73 (74 in FIG. 2). In this manner, the cut-out extensions 22, 24, (26 in FIG. 2) bend at substantially uniform angles within the inner cavity 42. The metal basket 20 is further configured to permit placement of the resistance element 30 such that the resistance element 30 is situated at a point itself equidistant from the periphery of the connector body top edge 41. In such a manner, upon installation over a subject cable port the resistance element 30 is introduced within the bore of such a port (not illustrated) and the threaded external portion of such a port is itself introduced within the inner cavity 42 of the connector body 10 and the cut-out extensions 22, 24 (26 in FIG. 2) can engage with the port threads.

Figure 2:
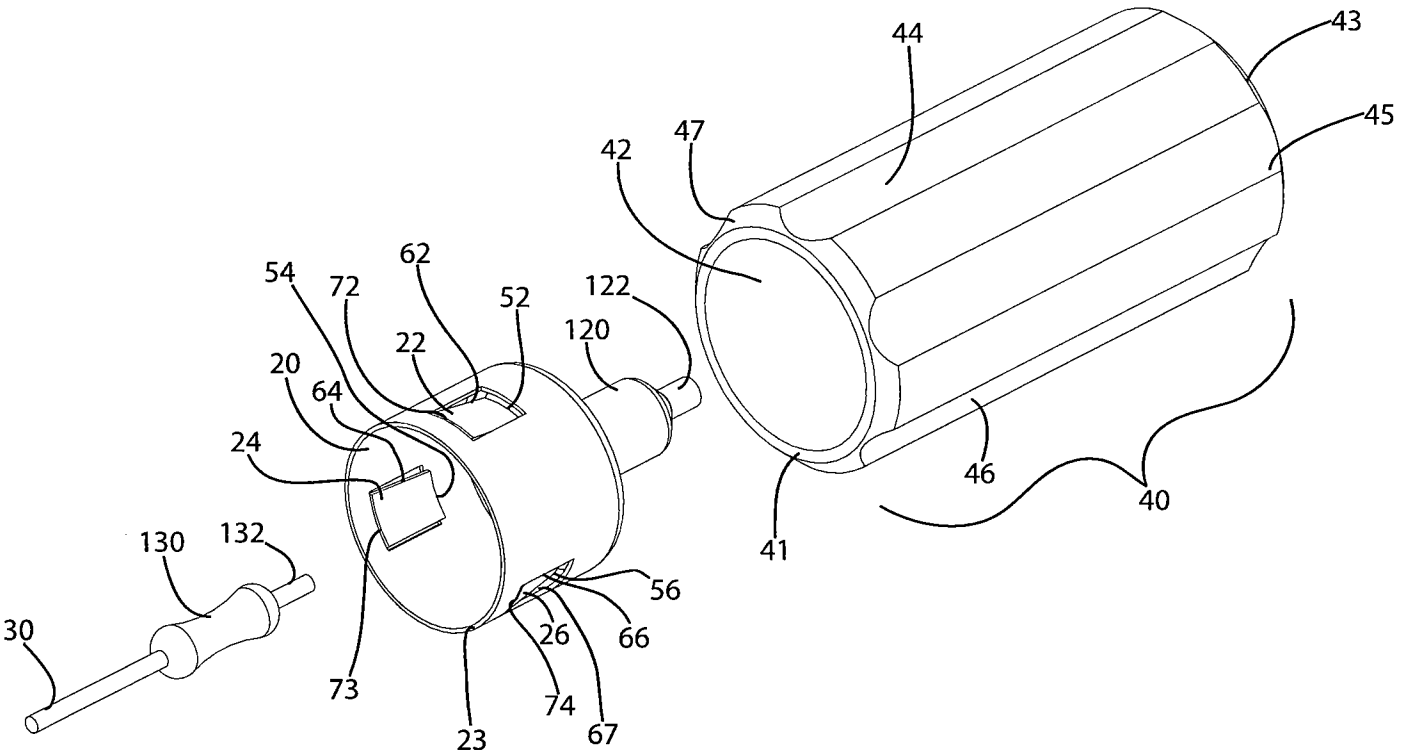
FIG. 2 depicts an exploded view of the same embodiment as in FIG. 1.

In FIG. 2, the resistance element 30 is shown with an enlarged portion 130 that is complementary in shape to a receptacle portion 120 within the metal basket 20 such that the resistance element 30 may be placed therein prior to inclusion within the final connector body 10 device. Furthermore, the resistance element 30 includes an end portion 132 that fits into an end receptacle 122 within the metal basket 20 to further enhance such placement (the element 30 may be fastened to the metal basket 20 through any acceptable manner, as noted above). As seen in FIG. 1, the connector body 10 also includes its own metal basket internal receptacle 110 into which the metal basket receptacles 120, 122 and thus the resistance element enlarged and end portions 130, 132 may be situated (and attached, as noted previously, via any acceptable manner). Additionally, the metal basket 20 includes a broader portion 80 (defining the open end of the metal basket 20 into which the port threads would be introduced) configured to complement the shape of the inner cavity 42 of the connector body 40 and exhibiting a substantially 90° bend in two places (82, 84 of FIG.1) leaving a rim 86 therein (defining the substantially closed end of the metal basket 20). On such a rim 86, or on the top edge of the connector body 41, a seal may optionally be included to prevent, or at least substantially reduce the propensity of, moisture ingress into the port connection upon installation. Proper attachment may be accomplished between all of these separate components through pressure fittings, adhesive application, a combination thereof, or any other manner of commonly accepted attachment. Such an overall configuration permits all of the individual components of the complete terminator device assembly 10 to move in concert upon application of proper force to the outer periphery of the connector body 40, such as a user's hand or a properly configured tool around or engaged with the grooves thereof 44 (45, 46, in FIGS. 2 and 3). Thus, the entire assembly 10 may be removed in such a manner without residual component parts attached to the target port (not illustrated).

Figure 3:
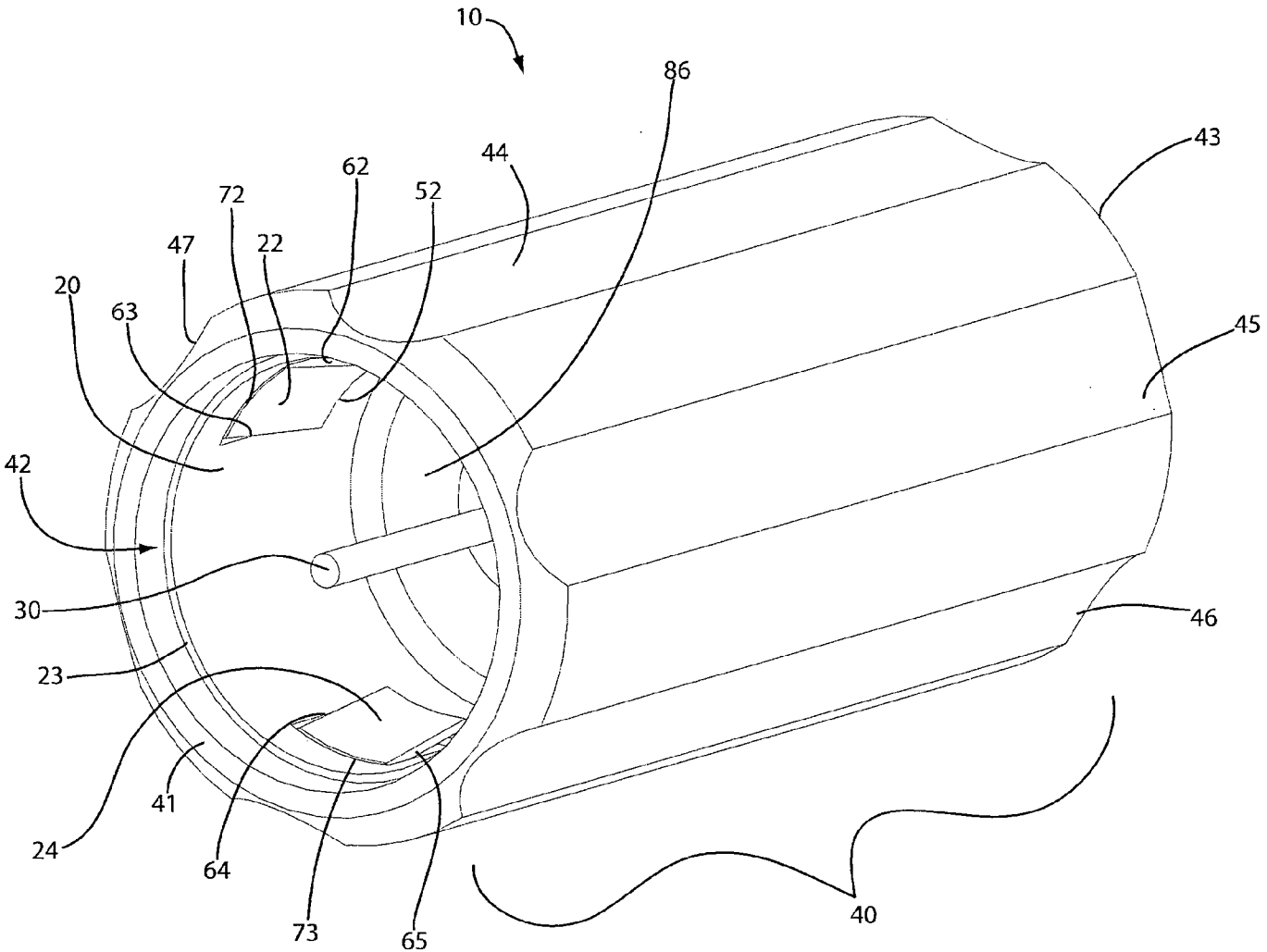
FIG. 3 depicts a side, complete view of the same embodiment as in FIGS. 1 and 2.

FIG. 3 thus shows the entire terminator device assembly 10 itself The connector body 40 covers the metal basket 20 and the resistance element 30, with the metal cut-out extensions 22, 23 (24 in FIG. 2) situated properly for installation over a target cable port. It is this open end of the inner cavity 42 within which a cable port is introduced, thereby allowing for the resistance element 30 (pin) to be introduced itself within the bore (not illustrated) of such a port, while the entire port itself is inserted within the connector body 40, as noted above. It is important to note that without the inclusion of the connector body 40 the metal basket 20 itself is properly configured with its open end (inner cavity) and substantially closed end formed by the rim (86 of FIG. 1 or 2) to permit introduction of a cable port. To increase the adhesion of the connector body 40 (or metal basket 20 alone) to the threaded port, an adhesive (as described previously) may be administered either to the port threads or the inner cavity walls 42 of the connector body 40 (or metal basket 20 alone) prior to axial introduction of the device assembly 10 over the port. If needed, the installer may then rotate the device 10 a slight degree to aid in further promotion of the adhesive to both the connector body 40 (or metal basket 20 alone) and the port threads. The resultant terminator device assembly is reliable, easy-to-install, and effective in preventing signal dissipation for an indefinite period of time within a cable television system. The method of installation thus provides the same basic benefits.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A cable system terminator device assembly for installation over a threaded terminal port, said assembly comprising an electrical resistance article and a conductive metal basket, wherein said metal basket has an open end and a substantially closed end with an inner cavity formed through such a configuration wherein the threaded terminal port will reside when connected thereto, wherein said open end of said metal basket includes a peripheral top edge, wherein said metal basket further includes a plurality of cut-out extensions therein such that said cut-out extensions include edges that flex outwardly during axial advancement of the metal basket onto the port and engage the threads of said port during axial advancement of the metal basket onto the port in a manner that prevents axial removal of said terminator device assembly from said port yet permits removal from said port through turning of said terminator device assembly.

2. The device of claim 1 wherein at least three cut-out extensions are present within said metal basket.

3. The device of claim 2 wherein all of said edges of said cut-out extensions are substantially equidistant from the peripheral top edge of said metal basket.

4. A cable system terminator device assembly for installation over a threaded terminal port, said assembly comprising an electrical resistance article and a conductive metal basket, wherein said metal basket has an open end and a substantially closed end with an inner cavity formed through such a configuration wherein the threaded terminal port will reside when connected thereto, wherein said open end of said metal basket includes a peripheral top edge, wherein said metal basket further includes a plurality of cut-out extensions therein such that said cut-out extensions include edges that flex outwardly during axial advancement of the metal basket onto the port and engage the threads of said port during axial advancement of the metal basket onto the port in a manner that prevents axial removal of said terminator device assembly from said port yet permits removal from said port through turning of said terminator device assembly; and wherein said device includes an external connector body having an inner cavity in which said electrical resistance article and said conductive metal basket are disposed.

5. The device of claim 4 wherein at least three cut-out extensions are present within said metal basket.

6. The device of claim 5 wherein all of said edges of said cut-out extensions are substantially equidistant from the peripheral top edge of said metal basket.

7. The device of claim 4 wherein said connector body is cylindrical in shape and includes an outer periphery, a bottom edge, and a top edge, wherein said top edge defines an opening into said inner cavity of said connector body.

8. The device of claim 7 wherein at least three cut-out extensions are present within said metal basket.

9. The device of claim 8 wherein all of said edges of said cut-out extensions are substantially equidistant from the peripheral top edge of said metal basket.

10. The device of claim 7 wherein said connector body includes a plurality of grooves along its outer periphery, and is attached to the metal basket with a suitable adhesive.

11. The device of claim 10 wherein at least three cut-out extensions are present within said metal basket.

12. The device of claim 11 wherein all of said edges of said cut-out extensions are substantially equidistant from the peripheral top edge of said metal basket.

13. The device of claim 7 wherein a seal is present on the top edge of said connector body.

14. A method of providing a secure, reliable, and easy-to-install termination at a vacant cable port through the installation of a terminator device assembly to a threaded vacant cable port, wherein the connection between said terminator device assembly and said port is accomplished through applying force axially to the terminator device assembly over the port to engage a thread of the port during axial advancement of a metal basket of the terminator device assembly, wherein removal of such a terminator device assembly therefrom said cable port is performed solely through application of external rotational force.

15. The method of claim 14 wherein an adhesive is applied either to the threads of said threaded port or the terminator device at a location in contact with said threads of said threaded port prior to installation of said device to said threaded port.

16. The method of claim 14 wherein said terminator device comprises an electrical resistance article and a conductive metal basket, wherein said metal basket has an open end and a substantially closed end with an inner cavity formed through such a configuration wherein the threaded terminal port will reside when connected thereto, wherein said open end of said metal basket includes a peripheral top edge, wherein said metal basket further includes a plurality of cut-out extensions therein such that said cut-out extensions include edges that flex outwardly during axial installation with said port and engage the threads of said port in a manner that prevents axial removal of said terminator device assembly from said port yet permits removal from said port through turning of said terminator device assembly.

17. The method of claim 16 wherein at least three cut -out extensions are present within said metal basket.

18. The method of claim 17 wherein all of said edges of said cut-out extensions are substantially equidistant from the peripheral top edge of said metal basket.

19. The method of claim 14 wherein said terminator device comprises an electrical resistance article and a conductive metal basket, wherein said metal basket has an open end and a substantially closed end with an inner cavity formed through such a configuration wherein the threaded terminal port will reside when connected thereto, wherein said open end of said metal basket includes a peripheral top edge, wherein said metal basket further includes a plurality of cut-out extensions therein such that said cut-out extensions include edges that flex outwardly during axial installation with said port and engage the threads of said port in a manner that prevents axial removal of said terminator device assembly from said port yet permits removal from said port through turning of said terminator device assembly; and wherein said device includes an external connector body having an inner cavity in which said electrical resistance article and said conductive metal basket are disposed.

20. The method of claim 19 wherein said connector body is cylindrical in shape and includes an outer periphery, a bottom edge, and a top edge, wherein said top edge defines an opening into said inner cavity of said connector body.

21. The method of claim 20 wherein at least three cut-out extensions are present within said metal basket.

22. The method of claim 21 wherein all of said edges of said cut-out extensions are substantially equidistant from the peripheral top edge of said metal basket.

23. The method of claim 20 wherein said connector body includes a plurality of grooves along its outer periphery.

24. The method of claim 23 wherein at least three cut-out extensions are present within said metal basket.

25. The method of claim 24 wherein all of said edges of said cut-out extensions are substantially equidistant from the peripheral top edge of said metal basket.

26. The method of claim 20 wherein a seal is present on the top edge of said connector body.

* * * * *